US006546632B2

(12) United States Patent
Gilbert

(10) Patent No.: US 6,546,632 B2
(45) **Date of Patent: *Apr. 15, 2003**

(54) UTILITY KNIFE

(75) Inventor: Richard Gilbert, Dronfield (GB)

(73) Assignee: The Stanley Works, New Britain, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/156,026

(22) Filed: May 29, 2002

(65) Prior Publication Data

US 2002/0144407 A1 Oct. 10, 2002

Related U.S. Application Data

(63) Continuation of application No. 09/374,205, filed on Aug. 13, 1999, now Pat. No. 6,449,850.

(51) Int. Cl.[7] ..... B26B 1/08
(52) U.S. Cl. ..... 30/162; 30/335
(58) Field of Search ..... 30/151, 162, 329, 30/335

(56) References Cited

U.S. PATENT DOCUMENTS

| | | | | |
|---|---|---|---|---|
| 3,520,059 | A | 7/1970 | Gringer | |
| 4,517,741 | A | 5/1985 | Castelluzzo | 30/162 |
| 4,524,518 | A | 6/1985 | West | 30/330 |
| 4,662,070 | A | 5/1987 | Reddig | 30/125 |
| 4,663,845 | A | 5/1987 | Weimann | 30/162 |
| 4,761,882 | A | 8/1988 | Silverstein | 30/162 |
| 4,930,218 | A | 6/1990 | Jacoff | 30/162 |
| 4,941,260 | A | 7/1990 | Castelluzzo | 30/162 |
| 4,953,293 | A | 9/1990 | Sterlacci | 30/124 |
| 5,005,290 | A | 4/1991 | Gilbert | 30/162 |
| 5,012,581 | A | 5/1991 | Fletcher et al. | 30/162 |
| 5,025,558 | A | 6/1991 | Gilbert | 30/125 |
| 5,036,591 | A | 8/1991 | Cousins | 30/335 |
| 5,086,562 | A | 2/1992 | Jacoff | 30/162 |
| 5,093,994 | A | 3/1992 | Karas | 30/125 |
| 5,099,578 | A | 3/1992 | Jan | 30/162 |
| 5,121,544 | A | 6/1992 | Gilbert | 30/162 |
| 5,230,152 | A | 7/1993 | Kennedy | 30/162 |
| 5,301,428 | A | 4/1994 | Wilcox | 30/162 |
| 5,425,855 | A | 6/1995 | Keklak et al. | 30/162 |
| 5,435,062 | A | 7/1995 | Huang | 30/125 |
| 5,603,162 | A | 2/1997 | Chen | 30/162 |
| 5,727,320 | A | 3/1998 | Shepherd et al. | 30/125 |
| 5,806,189 | A | 9/1998 | Bailey | 30/162 |
| 5,813,121 | A | 9/1998 | Gringer | 30/162 |
| 5,870,828 | A | 2/1999 | Polites | 30/162 |
| 5,875,551 | A | 3/1999 | Huang | 30/151 |
| 5,906,050 | A | 5/1999 | Gilbert | 30/162 |
| 5,950,311 | A | 9/1999 | Huang | 30/162 |
| 5,966,817 | A | 10/1999 | Lee | 30/162 |
| 6,000,136 | A | 12/1999 | Owens | 30/162 |
| 6,041,505 | A | 3/2000 | Chen | 30/162 |

*Primary Examiner*—Hwei-Siu Payer
(74) *Attorney, Agent, or Firm*—Pillsbury Winthrop LLP

(57) ABSTRACT

A utility knife comprises two elongate handle portions and a blade carrier assembly carrying a blade arranged to protrude from a front end of the handle. The upper handle portion has an aperture through a rear end part thereof. When the knife is assembled, the two handle portions are slid relatively longitudinally of one another, the upper handle portion moving forwardly of the lower handle portion, until a latch part near the rear end of the lower handle portion clicks into latching engagement with the front edge of the aperture in the upper handle portion. The upper handle portion is formed near its front end with interlocking elements, each having an integral, forwardly projecting piece at the bottom thereof. The front of the lower handle portion is formed with interlocking elements, each having an integral, rearwardly projecting piece at the top thereof, to overlie and hence interlock with a forwardly projecting piece at the bottom of the corresponding interlocking element of the upper handle portion. The upper portion further includes a forwardly-projecting flat tab which is received within a longitudinally-extending slot formed in the forward end of the lower handle portion.

8 Claims, 5 Drawing Sheets

UTILITY KNIFE

The present application is a continuation of U.S. patent application Ser. No. 09/374,205, filed Aug. 13, 1999 now U.S. Pat. No. 6,449,850, the entirety of which is hereby incorporated into the present application by reference.

BACKGROUND OF THE INVENTION

This invention relates to a utility knife comprising an elongate handle, formed by two elongate handle portions, and a blade carrier assembly, wherein the two handle portions are held together by mutually interlocking and overlapping nose portions and by a releasable locking structure.

In the field of utility knives, many different arrangements have been proposed for securing two mating handle halves to one another. One alternative for providing a simple mating of utility knife handle portions has been to provide a forwardly projecting tab at the forward end of one of the handle portions and a slot formed in the forward end of the other of the handle portions. The tab of one handle portion is inserted into the slot of the other handle portion, and the rearward portions of the handle portions are then releasably secured to one another.

It has been found that the tab and slot type of connecting arrangement has been beneficial in preventing a splaying of the handle portions away from one another when a bending or twisting force is applied to an extended knife blade during particularly demanding applications. This is primarily due to the fact that the connection between the handle portions in this type of tab and slot arrangement exists towards the very front end of the knife blade, where the large separating forces are primarily encountered.

As another alternative, commonly-assigned U.S. Pat. No. 5,121,544, having the same inventor as the present application, describes a utility knife comprising an elongate handle that can be assembled and disassembled without the need for additional tools. The handle is assembled by sliding the mating handle portions relatively longitudinally of one another until a latch part near the rear end of one handle portion snaps into latching-engagement with the front edge of an aperture formed in the other handle portion. Extending flank portions formed on each of the handle portions cooperate and overlie each other so as to interlock between the forward portions of the respective handle portions. Another similar interlock arrangement is disclosed in U.S. Pat. No. 5,005,290, also having common inventorship with the present application. It is known that the interlock arrangement is advantageous for its ease of assembly. In the '290 patent, the interlock also serves to grip the blade between the handle portions by also including a wedging surface on each of the interlocking members. The disclosure of U.S. Pat. Nos. 5,121,544 and 5,005,290 are hereby incorporated by reference.

Heretofore, the "wedge lock" type arrangement and the tab and slot arrangement have been considered to be mutually exclusive ways of connecting utility knife handle members, as there has been no recognized need or motivation to combine the two.

While many utility knife handles are made from metal to provide a robust, long life product, plastic is the material of choice from a manufacturing cost perspective. However, the Applicant has found that, with age, plastic handles employing the tab and slot arrangement may be vulnerable to breakage (particularly at a thin portion of plastic forming the slot) when it is subject to high levels of stress when the knife blade has a torsional or bending load applied thereto. In addition, because this type of connection is at the very front end of the handle, it is subject to direct impact if the utility knife is dropped.

To obviate this problem, the obvious solution to one skilled in the art would have been to reinforce the front end of the knife handle, for example, by using a metal insert or by using a larger plastic portion to form the slot. However, in accordance with the present invention, the Applicant has derived the unobvious solution by providing a plastic utility knife handle that employs a combination tab/slot and wedge lock connection, without modifying or rigidifying the tab/slot connection. This arrangement maintains the handle portions in connected relation in the event that the tab/slot arrangement should fail. Moreover, it has been found that the resistance to the splaying forces is more evenly distributed along the length of the knife handle such stresses are not concentrated. This reduces splaying or separation of the handle members during use, while also increasing the resistance to breakage by distributing the splaying forces.

In accordance with the present invention, there is provided a utility knife having an elongated handle with a front end and a rear end. The handle defines a cavity therein and includes carrier guide structure provided within the cavity. The elongated handle comprises a first plastic handle portion and a mating second plastic handle portion, each having front and rear ends corresponding to the front and rear ends of the elongated handle. Releasable locking structure is associated with the first handle portion and the second handle portion for releasably locking the first handle structure to the second handle structure. A blade carrier assembly is constructed and arranged to carry a knife blade and to be manually slidable on the carrier guide structure in a longitudinal direction with respect to the handle to selectively extend the knife blade outwardly from the front end of the handle or retract the knife blade into the cavity. The first handle portion comprises first interlock structure, including forwardly-extending first projections and a rearwardly-extending first recesses, and a projecting tab proximate the front end of the first handle portion and extending toward the front end of the first handle portion. The second handle portion comprises second interlock structure, including rearwardly-extending second projections and forwardly-extending second recesses, and a longitudinal slot proximate the front end of the second handle portion. The first and second handle portions are constructed and arranged to be cooperatively mated with one another to form the elongated handle by longitudinally displacing the first handle portion relative to the second handle portion so that (i) the first projections of the first interlock structure operatively engage with the second recesses of the second interlock structure, (ii) the second projections of the second interlock structure operatively engage with the first recesses of the first interlock structure, and (iii) the projecting tab of the first handle portion extends forwardly into the longitudinal slot formed in the front end of the second handle portion. An inside surface of the projecting tab and an opposed interior surface of the slot formed in the front end of the second handle portion define an opening in the front end of the handle through which the blade can be extended and retracted. The releasable locking structure prevents longitudinal displacement of the first handle portion relative to the second handle portion thereby preventing separation of the first handle portion from the second handle portion. The releasable locking structure is releasable to enable the first and second handle portions to be longitudinally displaceable relative to one another to enable (i) the first projections to be longitudinally moved out of the second recesses, (ii) the second projections to be longitudinally moved out of the first recesses, and (iii) the tab to be longitudinally moved out of the slot and thereby allow separation of the first and second handle portions.

Other objects, features, and characteristics of the present invention, as well as the methods of operation of the invention and the function and interrelation of the elements of structure, will become more apparent upon consideration of the following description and the appended claims with reference to the accompanying drawings, all of which form a part of this disclosure, wherein like reference numerals designate corresponding parts in the various figures.

DETAILED DESCRIPTION OF PREFERRED EMBODIMENT

Figure 1:
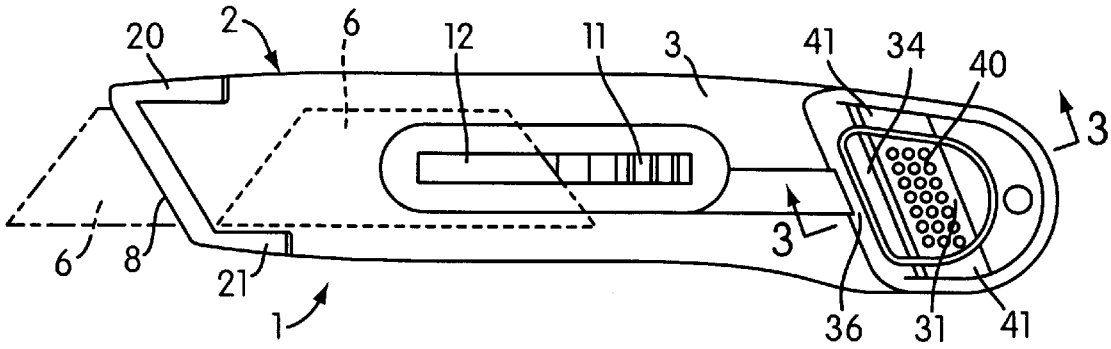
FIG. 1 is a front elevational view of a utility knife embodying the invention.
Figure 2:
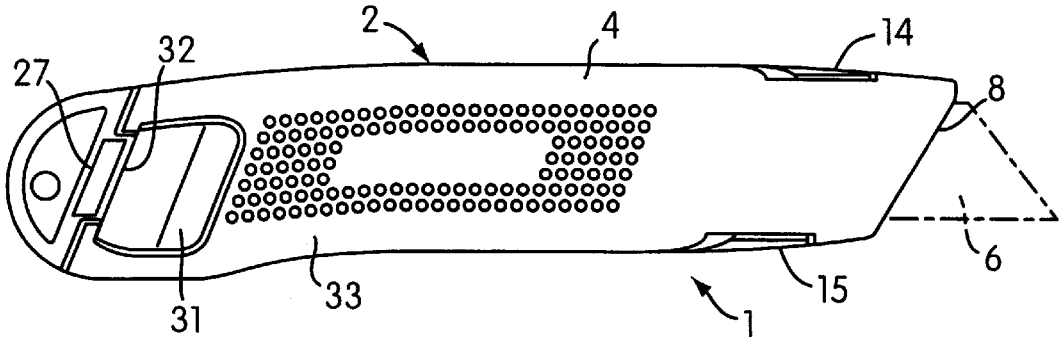
FIG. 2 is a rear elevational view of the utility knife embodying the invention of FIG. 1.
Figure 3:
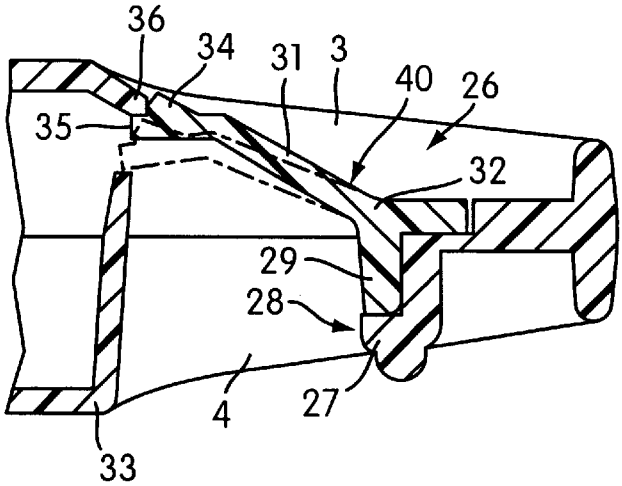
FIG. 3 is a section along the line 3—3 of FIG. 1.
Figure 4:
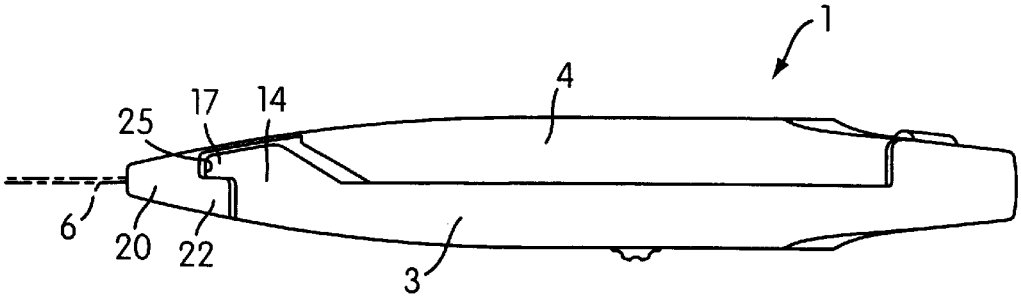
FIG. 4 is a top view of the knife of FIGS. 1 to 3.
Figure 5:
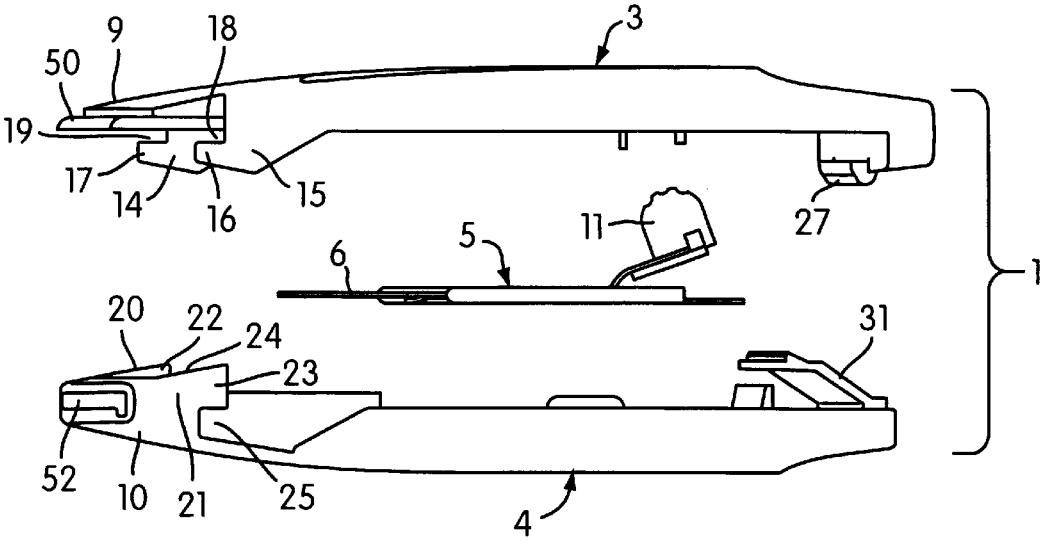
FIG. 5 is an exploded underneath view of the knife of FIGS. 1 to 4.

The invention will be described by way of example with reference to the drawings.

The illustrated utility knife 1 comprises an elongate handle 2 formed by first and second elongate handle portions 3, 4, preferably formed of plastic material, such as A.B.S., and a blade carrier assembly 5. A blade 6 is mounted on the blade carrier assembly 5, which is housed within the handle 2. Blade carrier assembly 5 is adapted to slide along guides 7 within the handle 2 towards and away from the front end 8 of the handle 2, to extend and retract the blade 6. When extended, the blade 6 protrudes from an outlet slot 52. The blade carrier assembly 5 is provided with a resiliently biased button 11 which protrudes through an elongate slot 12 in the upper handle portion 3 for extending and retracting the blade 6, the button 11 being biased into releasable engagement with internal detent formations 13 on the upper handle portion 3, at each side of the slot 12.

The first or upper handle portion 3 is formed near its front end 9 with a first interlock structure including a pair of forwardly-extending first projections 14, 15 and a pair of rearwardly-extending first recesses 18,19. The first projections 14, 15 are preferably in the form of two downwardly and longitudinally forwardly projecting flank portions or projections at the top and bottom sides of the upper handle portion 3, respectively, spaced rearwardly from the front end 9 of the upper handle portion 3. Each projection 14, 15 of the upper handle portion 3 has an integral, forwardly projecting piece 16, 17, respectively, at the bottom of the flank portion, to interlock with the lower handle portion 4 in a manner to be described. A flat, oblique tab 50 projects from the front end 9 of the upper handle portion 3.

The second or lower handle portion 4 is formed towards the front thereof with second interlock structure including a pair of rearwardly-extending second projections 20, 21 and a pair of forwardly-extending second recesses 24,25. Each of the interlocking projections 20,21, preferably in the form of flank portions of the lower handle portion 4, has an integral, rearwardly projecting piece 22, 23, respectively, to overlie and hence interlock with the forwardly projecting piece 16, 17 at the bottom of the corresponding flank portion 4, 5 of the upper handle portion 3.

Figure 6:
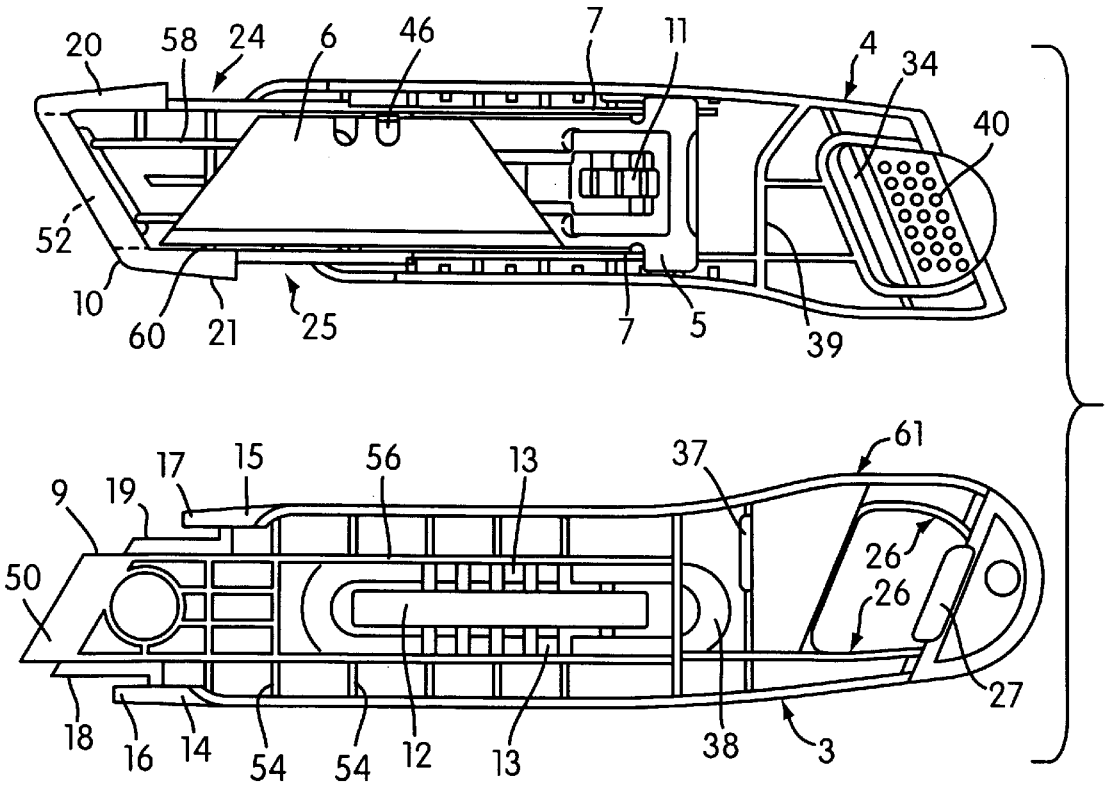
FIG. 6 is a view of the insides of the two handle portion and the blade carrier assembly with blade of the knife of FIGS. 1 to 5.

Specifically, as shown in FIGS. 6, the two recesses 24, 25 formed in the lower handle portion 4 behind its projections 20, 21, respectively, receive the two projections 14, 15 of the upper handle portion 3. Similarly, the upper handle portion 3 is cut away at recesses 18 and 19 to receive the flank portions 21,20, respectively, of the lower handle portion 4, for interlocking the two handle portions 3,4 together at the front end 8 of the handle 2.

An oblique slot 52 is formed longitudinally in the front end 10 of the lower handle portion 4, with the front end 10 providing structure that surrounds the slot 52 in a continuous, unbroken manner. As shown in the partial perspective views of FIGS. 10 and 11, the slot 52 is substantially rectangular in shaped formed between two opposing long wall portions 70 and 72, and two opposing shorter wall portions 74 and 76. The slot 52 is constructed and arranged to receive the tab 50 in the manner shown.

Releasable locking structure is associated with the first and second handle portions and releasably locks the first handle structure to the second handle structure. The releasable locking structure prevents longitudinal displacement of the first handle portion relative to the second handle portion thereby preventing separation of the first handle portion from the second handle portion. Preferably, the releasable locking structure is primarily constituted by a latch member provide on one of the handle portions and a latch engaging portion provided on the other handle portion, such as described below.

In the preferred construction, the upper handle portion 3 has an aperture 26 formed in a rear end part 61 of the upper handle portion 3. A projection 27 is directed forwardly from the rear edge of the aperture 26 and engages a rear wall 29 within recess 28 of the lower handle 4 portion to interlock the two handle portions 3, 4 together at the rear end of the handle 2.

The lower handle portion 4 has a resiliently deflectable, integrally formed latch member 31 which occupies the aperture 26 of the upper handle portion 3 when the two handle portions 3, 4 are assembled together. The latch member 31 is in the form of a cantilever extending generally forwardly and at an angle to the plane of the blade 6, to protrude into the aperture 26 from its attachment point at 32 to the rear end of a main body part 33 of the lower handle portion 4. A front end 34 of the latch member 31 is of stepped formation, to provide a narrow, forwardly projecting, ledge 35. This front end 34 of the latch member 31 latchingly engages a front edge 36 of the aperture 26 when the two handle portions 3, 4 are assembled together. The front edge 36 of the aperture 26 in the upper handle portion 3 presses down upon the ledge 35 of the latch member 31, giving the latch member 31 a slight resilient deflection to maintain latching engagement.

An internal, integral rib 37 of the upper handle portion 3 projects downwardly from a top wall 38 of the upper handle portion, and longitudinally engages the rear of an internal rib 39 of the lower handle portion 4, so as to tend to push the lower handle portion 4 forwardly of the upper handle portion 3 and thereby bias the front end 34 of the latch member 31 longitudinally of the handle 2 into its latching engagement with the front edge 36 of the aperture 26.

When the two handle portions 3, 4 are assembled together, the projections 14, 15 at the front end of the upper handle portion 3 fit generally behind the projections 20, 21 at the front end of the lower handle portion 4, interlocked by the lower handle portion flank portion pieces 22, 23 overlying the upper handle portion flank portion pieces 16, 17 as described above. The tab 50 extends into the slot 52. The external or upper surface 40 of the latch member 31 follows the contour of the external or upper surface 41 of the upper handle portion 3 around the edge of the aperture 26, sloping relative to the plane of the blade 6. The latch member 31 is resiliently deflectable out of the latching engagement with the front edge 36 of the aperture 26 by a manual pressure applied to the upper surface 40 of the latch member 31 within the aperture 26. The disengagement of latch member 31 necessitates—due to the angle of the latch member 31 to the plane of the blade 6—a very slight rearward movement of the lower handle portion 4 against the resilient bias of the spring leaf 37 of the upper handle portion 3. The two handle portions 3, 4 are thereupon longitudinally displaceable in the opposite direction relative to one another, the upper handle portion 3 moving rearwardly of the lower handle portion 4, to disengage the interlocking portions 3 and 4 at the front end and at the rear end of the handle 2 and thereby allow separation of the two handle portions 3, 4, for replacing the blade 6. Accordingly, it can be appreciated that handle 2 can be disassembled without the need for tools, such as a screwdriver or wrench.

When the knife 1 is reassembled, the two handle portions 3, 4 are slid relatively longitudinally of one another, the upper handle portion 3 moving forwardly of the lower handle portion 4, until the latch member 31 clicks into latching engagement with the front edge 36 of the aperture 26 in the upper handle portion 3.

Figure 7:
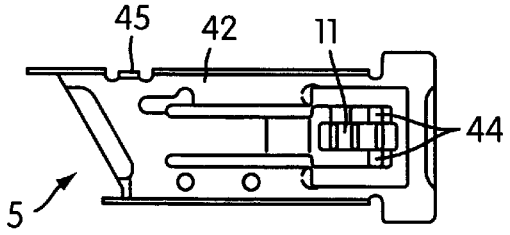
FIGS. 7, 8 and 9 are respectively a front view, a side view and an end view of the blade carrier assembly of the knife of FIGS. 1 to 6.
Figure 8:
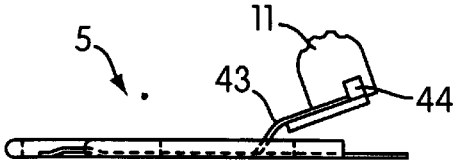
Figure 9:
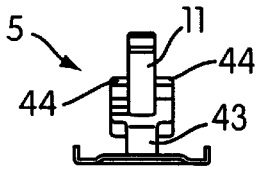

As shown in FIGS. 7 to 9, the blade carrier assembly 5 is of conventional construction, comprising a pressed metal piece 42 and the above-mentioned button 11, which may be a plastic button, assembled onto an upwardly bent cantilever spring portion 43 of the metal piece 42. The button 11 has side projections 44 to engage the detents 13 of the upper handle portion 3. The metal piece 42 is formed with the usual projection 45 to engage in a recess 46 in the non-cutting edge of the blade 6, to interlock the blade 6 with the blade carrier assembly 5 in a conventional manner. The blade 6 is extended by sliding the carrier assembly 5 longitudinally with regard to the handle 2. The spring 43 urges the projections 42 into the detents to releasably hold the carrier assembly 5 in a given position.

Figure 10:
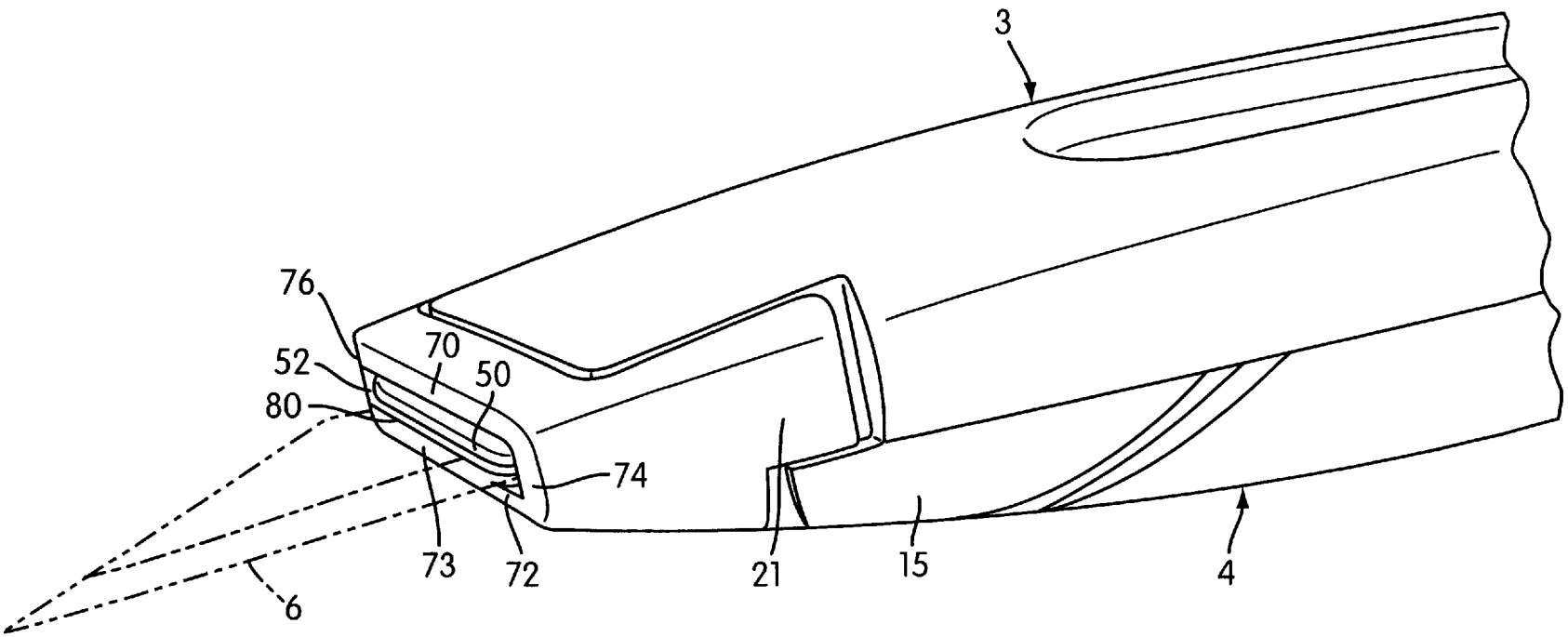
FIGS. 10 and 11 are partial perspective views of the front end of the utility knife in accordance with the present invention.
Figure 11:
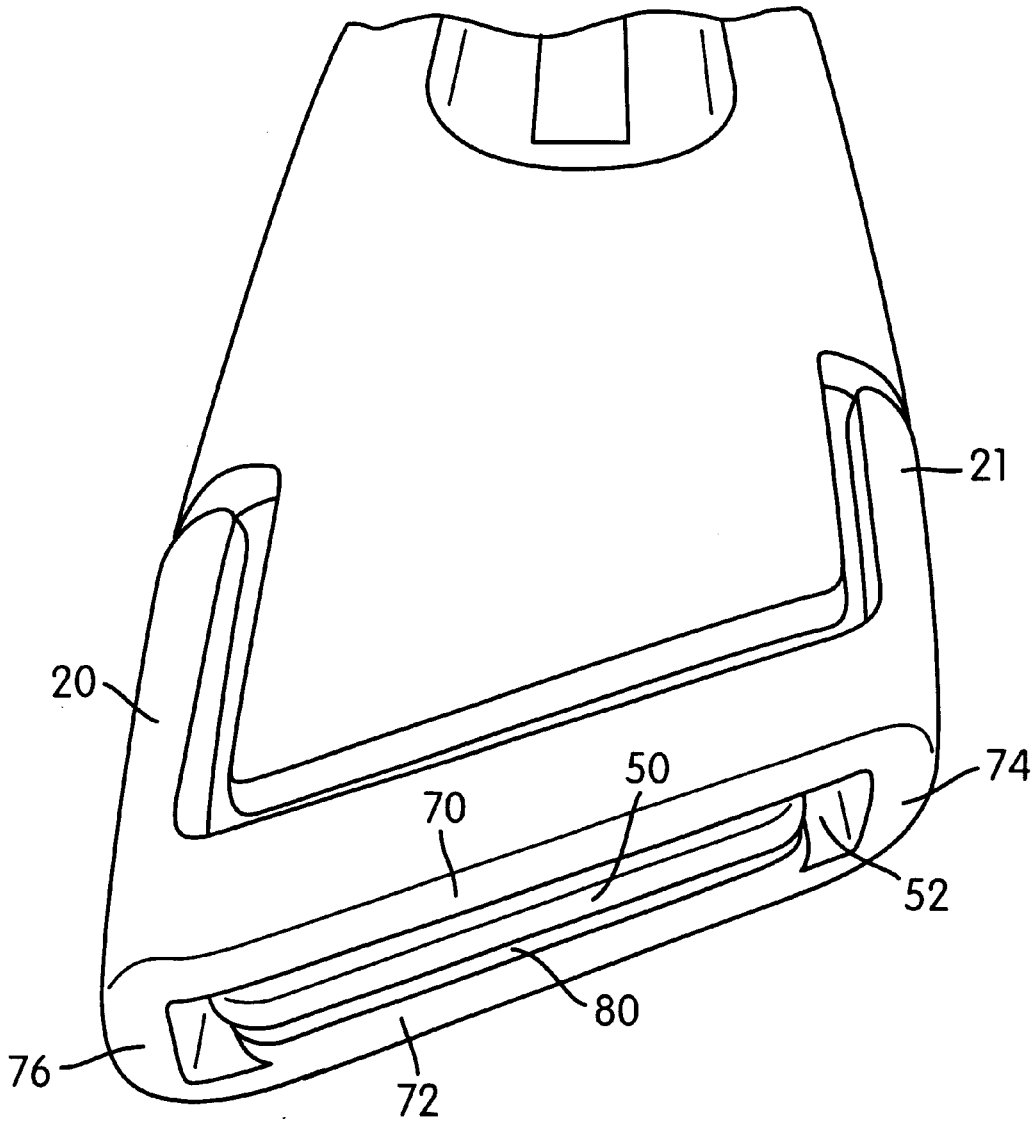

As shown in FIG. 10, the wall portion 72 forming part of the slot 52 has a thickened portion 73 that cooperates with the tab 50 to define a gap 80 therebetween. The blade 6 extends through the gap 80 between an inside surface of the tab 50 and an opposed interior surface of the thickened portion 73. Because the slot 52 has a continuous unbroken structure surrounding the tab 50, the handle portions resist being pried open by lateral or twisting forces acting on the blade 6.

While the invention has been described in connection with what is presently considered to be the most practical and preferred embodiment, it is to be understood that the invention is not to be limited to the disclosed embodiment, but, on the contrary, is intended to cover various modifications and equivalent arrangements included within the spirit and scope of the appended claims.

Furthermore, it should be noted that the appended claims not including language in the 'means for performing a specified function' format permitted under 35 U.S.C. §112 (¶6) are intended to not be interpreted under 35 U.S.C. §112(¶6) as being limited to the structure, material, or acts described in the present specification and their equivalents.

What is claimed is:

1. A utility knife comprising:

an elongated handle having a front end and a rear end, said handle defining a cavity therein and including carrier guide structure provided within said cavity, said elongated handle comprising a first plastic handle portion and a mating second plastic handle portion, each having front and rear ends corresponding to the front and rear ends of said elongated handle;

releasable locking structure associated with said first handle portion and said second handle portion, said releasable locking structure constructed and arranged to releasably lock said first handle portion to said second handle portion;

a blade carrier assembly constructed and arranged to carry a knife blade and to be manually slidable on said carrier guide structure in a longitudinal direction with respect to said handle to selectively extend the knife blade outwardly from the front end of the handle or retract the knife blade into said cavity;

said first handle portion comprising:

first interlock structure including a pair of forwardly-extending first projections and a pair of rearwardly-extending first recesses; and a projecting tab proximate the front end of said first handle portion and extending toward the front end of said first handle portion;

said second handle portion comprising:

second interlock structure including a pair of rearwardly-extending second projections and a pair of forwardly-extending second recesses; and a longitudinal slot proximate the front end of said second handle portion, said first and second handle portions being constructed and arranged to be cooperatively mated with one another to form said elongated handle by longitudinally displacing said first handle portion relative to said second handle portion so that (i) said first projections of said first interlock structure operatively engage with said second recesses of said second interlock structure, (ii) said second projections of said second interlock structure operatively engage with said first recesses of said first interlock structure, and (iii) said projecting tab of said first handle portion extends forwardly into said longitudinal slot formed in the front end of said second handle portion, wherein an inside surface of said projecting tab and an opposed interior surface of the slot formed in the front end of said second handle portion define an opening in the front end of the handle through which said blade can be extended and retracted, said releasable locking structure preventing longitudinal displacement of said first handle portion relative to said second handle portion thereby preventing separation of said first handle portion from said second handle portion, and said releasable locking structure being releasable to enable said first and second handle portions to be longitudinally displaceable relative to one another to enable (i) said first projections to be longitudinally moved out of said second recesses, (ii) said second projections to be longitudinally moved out of said first recesses, and (iii) said tab to be longitudinally moved out of said slot and thereby allow separation of said first and second handle portions.

2. A knife as claimed in claim 1, wherein said releasable locking structure comprises an aperture formed through a rear end part of one of said first handle portion and said second handle portion, and a resiliently deflectable, integrally formed latch part on the other of said first handle portion and said second handle portion, said latch part being in the form of cantilever extending generally forwardly to protrude into said aperture, a front end of said latch part latchingly engaging a front edge of said aperture and being biased longitudinally of the handle into said latching engagement by manual pressure applied through said aperture.

3. A knife as claimed in claim 1, wherein said first and second interlock structures are integrally formed with said first and second handle portions, respectively.

4. A knife as claimed in claim 1, wherein said releasable locking structure includes an opposed longitudinally projecting member and complementary recess on opposite handle portions that cooperate upon relative longitudinal movement of said handle portions to retain and release the locking engagement between said portions.

5. A utility knife comprising:

an elongated handle having a front end and a rear end, said handle defining a cavity therein and including carrier guide structure provided within said cavity, said elongated handle comprising a first handle portion and a mating second handle portion, each having front and rear ends corresponding to the front and rear ends of said elongated handle;

releasable locking structure associated with said first handle portion and said second handle portion, said releasable locking structure constructed and arranged to releasably lock said first handle portion to said second handle portion;

a blade carrier assembly constructed and arranged to carry a knife blade and to be manually slidable on said carrier guide structure in a longitudinal direction with respect to said handle to selectively extend the knife blade outwardly from the front end of the handle or retract the knife blade into said cavity;

said first handle portion comprising:

first interlock structure including a pair of forwardly-extending first projections and a pair of rearwardly-extending first recesses; and a projecting tab proximate the front end of said first handle portion and extending toward the front end of said first handle portion;

said second handle portion comprising:

second interlock structure including a pair of rearwardly-extending second projections and a pair of forwardly-extending second recesses; and a longitudinal slot proximate the front end of said second handle portion, said first and second handle portions being constructed and arranged to be cooperatively mated with one another to form said elongated handle by longitudinally displacing said first handle portion relative to said second handle portion so that (i) said first projections of said first interlock structure operatively engage with said second recesses of said second interlock structure, (ii) said second projections of said second interlock structure operatively engage with said first recesses of said first interlock structure, and (iii) said projecting tab of said first handle portion extends forwardly into said longitudinal slot formed in the front end of said second handle portion, wherein an inside surface of said projecting tab and an opposed interior surface of the slot formed in the front end of said second handle portion define an opening in the front end of the handle through which said blade can be extended and retracted, said releasable locking structure preventing longitudinal displacement of said first handle portion relative to said second handle portion thereby preventing separation of said first handle portion from said second handle portion, and said releasable locking structure being releasable to enable said first and second handle portions to be longitudinally displaceable relative to one another to enable (i) said first projections to be longitudinally moved out of said second recesses, (ii) said second projections to be longitudinally moved out of said first recesses, and (iii) said tab to be longitudinally moved out of said slot and thereby allow separation of said first and second handle portions.

6. A knife as claimed in claim 5, wherein said releasable locking structure comprises an aperture formed through a rear end part of one of said first handle portion and said second handle portion, and a resiliently deflectable, integrally formed latch part on the other of said first handle portion and said second handle portion, said latch part being in the form of cantilever extending generally forwardly to protrude into said aperture, a front end of said latch part latchingly engaging a front edge of said aperture and being biased longitudinally of the handle into said latching engagement by manual pressure applied through said aperture.

7. A knife as claimed in claim 5, wherein said first and second interlock structures are integrally formed with said first and second handle portions, respectively.

8. A knife as claimed in claim 5, wherein said releasable locking structure includes an opposed longitudinally projecting member and complementary recess on opposite handle portions that cooperate upon relative longitudinal movement of said handle portions to retain and release the locking engagement between said portions.

* * * * *